US008391540B2

(12) United States Patent
Berriman et al.

(10) Patent No.: US 8,391,540 B2
(45) Date of Patent: Mar. 5, 2013

(54) BENDING WAVE ACOUSTIC DEVICE AND METHOD OF MAKING THEREOF

(75) Inventors: David Keith Berriman, Cambridgeshire (GB); Christien Ellis, Cambridgeshire (GB); Martin Colloms, Cambridgeshire (GB); Graham Bank, Cambridgeshire (GB); Neil John Harris, Cambridgeshire (GB); Douglas Andrew Marchant, Cambridgeshire (GB)

(73) Assignee: New Transducers Limited, Cambridgeshire (GB)

( * ) Notice: Subject to any disclaimer, the term of this patent is extended or adjusted under 35 U.S.C. 154(b) by 864 days.

(21) Appl. No.: 12/087,754

(22) PCT Filed: Jan. 18, 2007

(86) PCT No.: PCT/GB2007/000157

§ 371 (c)(1), (2), (4) Date: Jun. 23, 2009

(87) PCT Pub. No.: WO2007/083127

PCT Pub. Date: Jul. 26, 2007

(65) Prior Publication Data

US 2009/0290732 A1 Nov. 26, 2009

(30) Foreign Application Priority Data

Jan. 19, 2006 (GB) ..... 0601076.3

(51) Int. Cl.
*H04R 1/00* (2006.01)

(52) U.S. Cl. ..... 381/431

(58) Field of Classification Search ..... None
See application file for complete search history.

(56) References Cited

U.S. PATENT DOCUMENTS

| | | | | |
|---|---|---|---|---|
| 4,426,556 | A | 1/1984 | Saiki et al. | |
| 6,332,029 | B1 * | 12/2001 | Azima et al. | 381/152 |
| 2001/0048751 | A1 * | 12/2001 | Ellis | 381/431 |

FOREIGN PATENT DOCUMENTS

| | | | |
|---|---|---|---|
| EP | 1 170 977 | A1 | 1/2002 |
| WO | WO 00/15000 | | 3/2000 |
| WO | WO 00/70909 | | 11/2000 |
| WO | WO 2005/101899 | A2 | 10/2005 |

OTHER PUBLICATIONS

International Preliminary Report on Patentability for PCT/GB2007/000157, issued Jul. 22, 2008, 8 pgs.
International Search Report for PCT/GB2007/000157 mailed Nov. 6, 2007, 3 pgs.

* cited by examiner

*Primary Examiner* — Yuwen Pan
*Assistant Examiner* — Taunya McCarty
(74) *Attorney, Agent, or Firm* — Roylance, Abrams, Berdo & Goodman; Alan I. Cantor

(57) ABSTRACT

An acoustic device and method of making said acoustic device. The acoustic device comprises a diaphragm having resonant bending wave modes in the operating frequency range, and a plurality of electromechanical transducers coupled to the diaphragm. The positioning and mechanical impedance of the transducers are such that at least a selected number of the resonant bending wave modes are balanced so that the net transverse modal velocity over the area of the diaphragm tends to zero with the balancing of the resonant bending wave modes being achieved substantially by the positioning and mechanical impedance of the transducers. The parameters of the diaphragm may be such that there are a plurality of nodal grouped locations at or around which the nodal lines of a selected number of resonant modes are clustered. Each transducer may be mounted at one of the plurality of nodal grouped locations.

65 Claims, 10 Drawing Sheets

BENDING WAVE ACOUSTIC DEVICE AND METHOD OF MAKING THEREOF

TECHNICAL FIELD

The invention relates to acoustic devices, such as loudspeakers and microphones. More particularly, the present invention relates to acoustic devices of the general kind described in our International Application WO2005/101899A which is herein incorporated by reference. Such devices are known as balanced mode radiators or by the initials BMR.

BACKGROUND ART

The prior art takes a number of approaches to making potentially modal diaphragms act like a piston:

1) drive on the nodal line of a chosen mode to suppress that specific mode (usually the lowest mode),
2) drive uniformly over the entire area, such as is the case with an electrostatic or Magnaplanar speaker, or
3) specific, asymmetric arrangements of two drivers, see for example U.S. Pat. No. 4,426,556 of Matsushita.

The BMR teaching of WO2005/101899A aims to balance a modal radiator such that its modes resemble those of the free panel up to a chosen order. It achieves this balance by appropriate selection of the positioning and mass of the drive part of the transducer and of at least one mechanical impedance means, e.g. mass.

DISCLOSURE OF INVENTION

From one aspect the invention is an acoustic device comprising a diaphragm having an area and having an operating frequency range and the diaphragm being such that it has resonant bending wave modes in the operating frequency range, and a plurality of electro-mechanical transducers coupled to the diaphragm and adapted to exchange energy with the diaphragm, characterised in that the positioning and mechanical impedance of the transducers are such that the net transverse modal velocity over the area of the diaphragm is at least reduced to tend to balance at least selected modes in the operating frequency range with the balancing of the selected resonant bending wave modes being achieved substantially by the positioning and mechanical impedance of the transducers.

From another aspect the invention is a method of making an acoustic device having a diaphragm having an area and having an operating frequency range, comprising choosing the diaphragm parameters such that it has resonant modes in the operating frequency range, coupling a plurality of electromechanical transducers to the diaphragm to exchange energy with the diaphragm, characterised by selecting the positions and mechanical impedance of the transducers so that the net transverse modal velocity over the area is at least reduced to tend to balance at least selected modes in the operative frequency range with the balancing of the selected resonant bending wave modes being achieved substantially by the positioning and mechanical impedance of the transducers.

As described in WO2005/101899A, the net transverse modal velocity over the area may be quantified by calculating the rms (root mean square) transverse displacement. The positions and mechanical impedance of the transducer are such that the net transverse model velocity preferably tends towards zero. An example calculation for a circular diaphragm is described in WO 2005/101899. To achieve net transverse modal velocity over the area tending to zero, the relative mean displacement may be less than 25%, or preferably less than 18% of the rms transverse velocity.

Furthermore as described in WO2005/101899A, for zero net transverse modal velocity, the modes of the diaphragm need to be inertially balanced to the extent, that except for the "whole body displacement" or "piston" mode, the modes have zero mean displacement (i.e. the area enclosed by the mode shape above the generator plane equals that below the plane). This means that the net acceleration, and hence the on-axis pressure response, is determined solely by the pistonic component of motion at any frequency.

WO2005/101899A describes different methods for achieving net transverse modal velocity tending to zero. One method involves calculating locations where the drive point impedance Zm is at a maximum for the modes of an ideal theoretical acoustic device. Since the impedance Zm is calculated from a modal sum, the calculated locations depend on the number of modes included in the sum. Generally, the locations will tend to be near the nodes of the highest mode considered, but the influence of the other modes means that the correspondence may not be exact. The locations are thus considered to be average nodal locations.

In the present invention, the drive parts of the transducers are preferably mounted at average nodal locations. Such locations may be on (or near) the nodal lines of a chosen mode, i.e. the fourth mode and are described in WO2005/101899A. In this way, the modes up to the chosen one are balanced, whether or not they are suppressed. Driving at average nodal locations moderates the amplitude of the modes but may not suppress the mode. Modal action is essential so that the modal output may be brought into radiation balance.

The multiple (i.e. n) transducers may each be mounted at an average nodal location of the nth mode. Mounting at average nodal locations ensures that the net force applied to each mode approaches zero. The resulting motion resembles that of a piston. However, the device is not merely a piston but also a resonant radiator in which a number of the lowest order modes are not strongly excited.

The device thus addresses the radiation problem of the piston to modal transition in which driven modes are generally unbalanced in respect of their radiation resulting in large peaks and dips in the axial frequency response and also the power response.

The placing of the transducers may or may not be symmetrical on the diaphragm. The symmetry issue is based on the theory of modal balance. The diaphragm may have more than one modal axis which is subject to the balancing method. For example, a rectangular diaphragm may have three symmetrically placed transducers for the longer axis and a pair of transducers for the other axis.

An additional useful design variable is that some or all of the transducers may have equal or different drive magnitudes and/or masses. Furthermore, the mechanical impedance of a transducer may be varied more or less independently of the drive force or power of the transducer. The mechanical impedance of each transducer may be matched to the effective mechanical impedance at the drive location. The matched mechanical impedance may take into account the properties of mechanical and electromagnetic damping, reflected compliance, drive mass and available drive force. At low frequencies, this global approach is useful because it provides a good prediction of the underlying piston range output. This parallels the low frequency parameter method used with conventional piston drivers to design conventional box loudspeakers.

The transducers may be inertial or grounded. The transducers may be piezoelectric devices, bender devices or moving coil devices.

In contrast to WO2005/101899A, the modal balancing is achieved substantially by the positioning and mechanical impedance of the transducers alone. The balancing may preferably be achieved entirely by the positioning and mechanical impedance of the transducers. In other words, mechanical impedances (e.g. masses) are not essential. Nevertheless, the acoustic devices of the invention may benefit from some fine tuning by the application of mechanical impedance components in selected locations to the diaphragm. These may be used to trim the frequency response in certain ranges, or to higher order modes which due to their density are not resolvable through the average nodal method.

For example in a given application it may be found useful to adjust the level of one frequency range relative to another. A design with too great a low range may be adjusted be applying distributed mass to the diaphragm via a compliant intermediary layer. The damping and compliance of the intermediate layer may be designed in conjunction with the distributed mass (so as not to prevent the application of average nodal methods) to load the diaphragm at low frequencies to reduce the output while at higher frequencies the compliance allows the mass to decouple and leave this range unaffected. Thus broad range equalisation is effected mechanically.

In another example, one or more of the plurality of transducers may be passive (i.e. not fed with an electric signal) and thus only its dominant mass feature is used for modal balancing. The passive transducer may be electrically unconnected or may remain connected to an active amplifier. In the latter case, there will be some electromagnetic damping from the drive to the panel.

Using a combination of passive and active transducers may be useful for devices capable of reproducing more than one signal channel. For example, left and right channels may be directed to left and right hand areas on the panel. At higher frequency, the transducers may be driven for higher order, more localised modes on an individual basis. At lower frequencies, suitable signal summing may encourage the transducers to operate in concert, in phase, acting on average groups of lower order nodal lines. The result is a summed output, balanced drive for low frequencies and a spaced source stereo reproducer at higher frequencies.

The transducer may be adapted to move the diaphragm in translation. The transducer may be a moving coil device having a voice coil which forms the drive part and a magnet system. A resilient suspension may couple the diaphragm to a chassis. The magnet system may be grounded to the chassis.

Suitable materials for the suspension include moulded rubber or elastic polymer cellular foamed plastics. In design, the physical position of the suspension on the diaphragm may be adjusted to find the best overall match in the operating frequency range. Additionally or alternatively the behaviour of the suspension may be modelled, e.g. with FEA to ascertain the effective centre of mass, damping and stiffness. Its properties may be calculated as an effective lumped parameter at effective notional locations with respect to the perimeter of the diaphragm. The positions/mass of the transducers may then be adjusted to compensate for the mechanical impedance effect of the suspension.

According to a third aspect of the invention, there is provided an acoustic device comprising a diaphragm having an area and having an operating frequency range and the diaphragm being such that it has resonant modes in the operating frequency range, and at least one electro-mechanical transducer having a drive part coupled to the diaphragm and adapted to exchange energy with the diaphragm, characterised in that the parameters of the diaphragm are such that there are a plurality of nodal grouped locations at or around which the nodal lines of a selected number of resonant modes are clustered and the drive part coupling of the at least one transducer is mounted at one of the plurality of nodal grouped locations.

From another aspect the invention is a method of making an acoustic device having a diaphragm having an area and having an operating frequency range, comprising choosing the diaphragm parameters such that it has resonant modes in the operating frequency range, coupling the drive part of at least one electromechanical transducer to the diaphragm to exchange energy with the diaphragm, characterised by selecting the parameters of the diaphragm so that there are a plurality of nodal grouped locations at or around which the nodal lines of a selected number of resonant modes cluster and coupling the drive part of the at least one transducer at one of the plurality of nodal grouped locations.

The selected modes may be low frequency resonant modes, e.g. the first two or more modes. In this way, the transducer may be mounted on or near to the nodal lines of all modes up to a chosen mode, e.g. up to the fourth mode. Alternatively, the selected modes may comprise only even or odd modes, or any combination there of including all modes in the operating frequency range.

The terms "odd" and "even" refer to the number of the mode. The numbers refer to the number of the nodal line with (0,2) defined as the first resonant bending wave mode since there is no bending in one direction and two nodal lines in the other. For completeness, it is noted that (0,1) is the "whole" body or piston mode. As a consequence of this notation, odd modes are anti-symmetric and even modes are symmetric. Appropriate selection of the combination of odd and even modes may improve axial frequency response. There is also the potential through locating the transducers at selected nodal grouped locations to support the whole body contribution, i.e. the encouragement of semi-pistonic action at the lowest available frequency in order to provide the widest frequency range.

For a symmetric object such as a circular diaphragm, or a beam-like diaphragm which may be considered as a section across the centre of a circular diaphragm, the symmetrical modes are balanced and do not radiate on axis. The anti-symmetrical modes are those which are unbalanced and need to be considered when designing the acoustic device. The first and second even modes are coincident for such symmetrical objects and thus transducers may be mounted simultaneously on nodes of both these modes to provide radiation balancing of the modes.

There may be a plurality of transducers (i.e. n) each of which is mounted a nodal grouped location. The number of transducers may correspond to the number of nodal grouped locations, i.e. n transducers mounted at n locations.

Drives for such locations tend to result in a balance of modal radiation for those modes thus improving the axial pressure response for the radiator. In other words, these grouped locations may correspond to the average nodal locations taught in WO2005/101899A but not necessarily so.

The diaphragm parameters include shape, size (aspect ratio), thickness, bending stiffness, surface area density, shear modulus, anisotropy, curvature and damping. The diaphragm may be a panel and may be planar, curved or dished.

The diaphragm may have a regular (uniform) shape, e.g. rectangular, circle, or other regular polygon. Alternatively, the diaphragm may have a more complex geometric shape and the shape may have been selected according to the desired position of or to the desired combination of nodal lines clustered in selected nodal grouped locations. The diaphragm may also be provided with grooves which have sufficient depth to provide a impedance discontinuity which may significantly reduce transmission of resonant bending wave vibration beyond the grooves. In this way, the shape may be vibrationally resolved into a simpler shape, e.g. circle, rectangle.

The diaphragm may have uniform thickness. Alternatively, the diaphragm may be formed with integral contours or ridges, e.g. by heat and compression during thermo-forming processes or vacuum moulding. The contours or ridges may displace nodal lines to alter the position of or the nodal lines clustered in selected nodal grouped locations. Such contours or ridges exploit local stiffness variation.

Local thickness of the diaphragm may also be increased by adding an "I" shaped extension which does not materially increase local stiffness in the dominant plane of bending. Additional masses may also be integrally formed with the diaphragm, e.g. by co-moulding. The "I" shaped extension and/or integral masses may compensate, balance or adjust other vibrational modes, e.g. higher order modes.

Moulding the diaphragm offers additional advantages over cutting diaphragms from sheet or composite materials, e.g. a higher quality surface finish, the opportunity for trademark and similar identification potential including surface relief and decorative artwork. Grooves or ledges for accurate registration of speaker components, e.g. the surround suspension and/or voice coil former, may also be integrally incorporated into the diaphragm. Locking members, moulded hooks, tapered grooves or undercut grooves to capture components may also be integrally incorporated into the diaphragm.

The combination of parameters may be such that a complex geometry which may be required for styling reasons behaves as a regular shape which may be modelled using standard techniques. The combination of parameters may include variation in areal mass and stiffness or grooving. For example, a sub-section of moulded automotive trim, perhaps the cover for an "A" pillar, may be designed to behave acoustically as a more regular shape to which the invention may then be applied.

In each embodiment, the acoustic device may be a loudspeaker wherein the transducer is adapted to apply bending wave energy to the diaphragm in response to an electrical signal applied to the transducer and the diaphragm is adapted to radiate acoustic sound over a radiating area. Alternatively, the acoustic device may be a microphone wherein the diaphragm is adapted to vibrate when acoustic sound is incident thereon and the transducer is adapted to convert the vibration into an electrical signal. The operating frequency range may include the piston-to-modal transition. The diaphragm parameters may be such that there are two or more diaphragm modes in the operating frequency range above the pistonic range. The acoustic device may operate as a piston at lower frequencies and a complex modal radiator at higher frequencies. The first resonance or whole body mode is preferably encouraged to address the known problem for a modal radiator, namely of the difficult transition at lower frequencies resulting from the large gap in output between the first and the new few modes.

The parameters of the device may be selected to achieve a desired ratio of pistonic to modal output. It is the contribution from the modal behaviour which provides the benefit of off-axis power at high frequencies. For a rear channel application or surround speaker where a weaker correlated axial output is desirable to provide less directive spread of ambient sound, reducing the pistonic contribution relative to the modal contribution is desirable. Such devices have an improved ratio of off-axis radiation to on-axis radiation. The amplitude of the on-axis pistonic component may be reduced by appropriate scaling and location of the transducers or by varying the phase of the drives with frequency.

For devices extending to low frequencies, the usual parameters which relate to low frequency system design, namely bass reflex loading, sealed box and related methods may be used to optimise the performance and power handling. Such properties are essentially independent of the criteria used to balance the modal radiation in the required frequency range.

Any of the features of the first and second embodiments of the invention may be combined with any of the features of the third and fourth inventions.

When designing a device according to any one of the invention, it would be helpful for the designer to have access to one of the commonly available modal analyzer or FEA packages which would facilitate inspection of mode behaviour and node lines and thus placement of exciters and the resulting acoustic behaviour.

BRIEF DESCRIPTION OF DRAWINGS

The invention is diagrammatically illustrated, by way of example, in the accompanying drawings in which.

DETAILED DESCRIPTION OF THE DRAWINGS

Figure 1A:
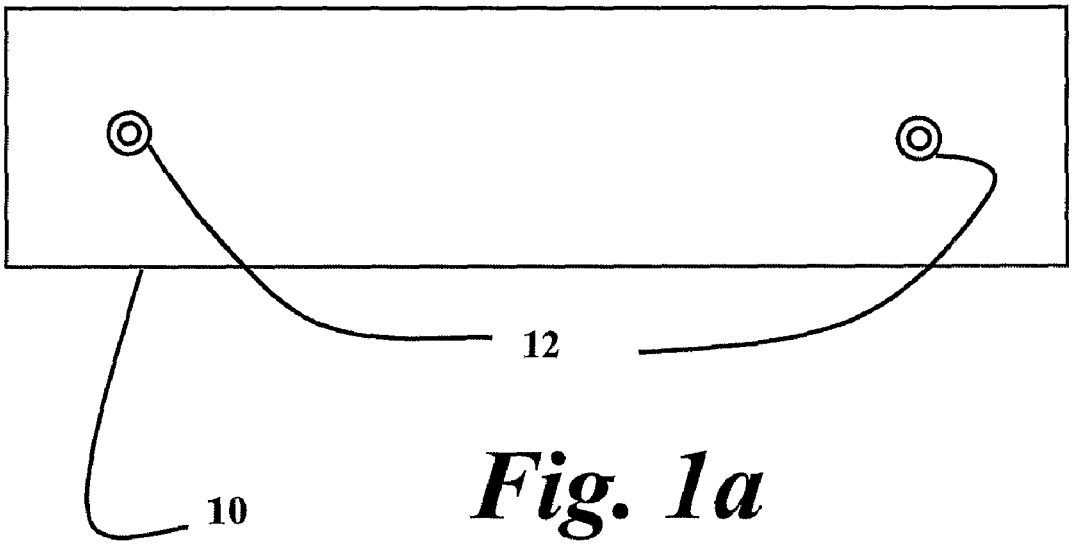
FIG. 1*a* is a plan view of a first embodiment of loudspeaker according to the first and second aspects of the invention.

FIG. 1*a* shows a loudspeaker comprising a diaphragm 10 capable of supporting resonant bending wave modes and a pair of transducers 12 symmetrically mounted thereon to excite resonance in the diaphragm. The diaphragm 10 is in the form of a beam-shaped panel. The transducers are located along the long axis of the panel each at a distance of 23% of the length of the panel from the short edges of the panel. The two transducers are located near to the nodal lines for the first and second modes.

For this two mode solution to be valid, it is necessary to mount the diaphragm so that it acts as a free plate. In conventional drive unit radiators, mechanical terminations are present both at the centre and at the periphery. However, such terminations strongly unbalance the modal radiation contribution.

In the present invention, support and suspension components may be provided which in mechanical terms are so light in action that they do not interfere with the required radiation balanced mode behaviour. Alternatively, these components are specifically designed to form a part of the balanced acoustical system.

Figure 1B:
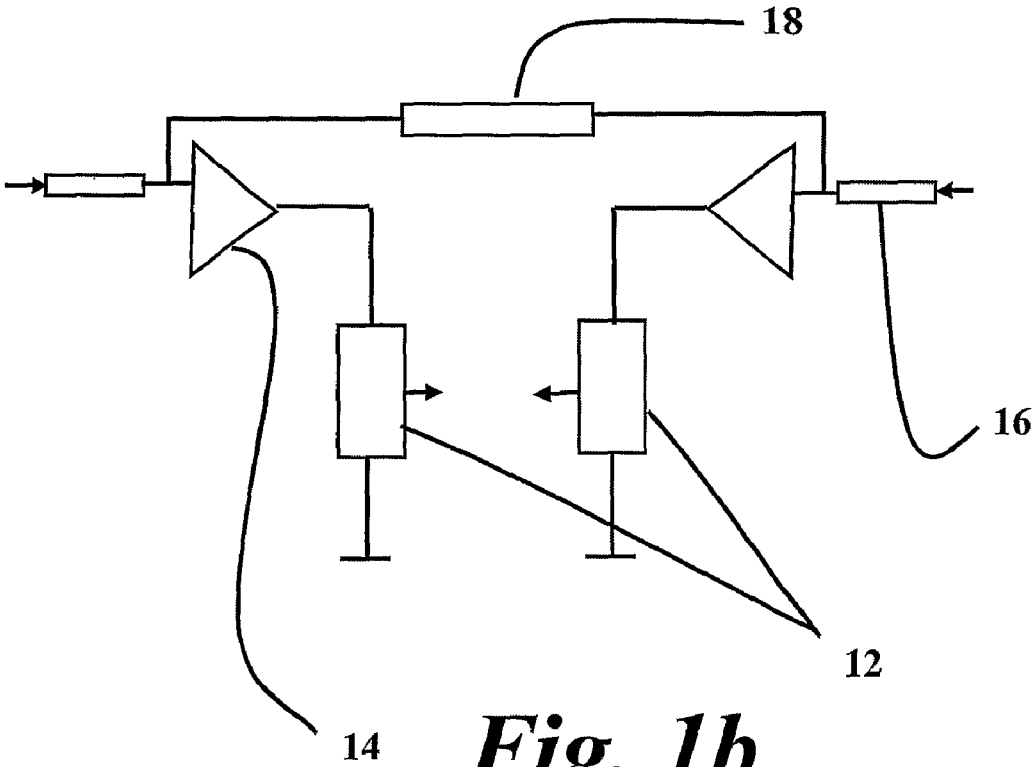
FIG. 1*b* is a circuit diagram relating to the embodiment of FIG. 1*a;*

As shown in the circuit diagram of FIG. 1*b*. Each transducer 12 is connected to a corresponding amplifier 14 which is connected to a corresponding resistor 16. Both amplifiers 14 are also connected to low pass filter, e.g. an inductor. The two separated transducers constitute the left and right signal channels. The low pass filter ensures that both transducers are operating at higher frequencies to achieve the requirement for separate sources over the breadth of the resonant panel. This is because the more complex higher frequency modal distribution tends to localise in the region of the exciter an acoustical approximation to a wide directivity point source.

Figure 2A:
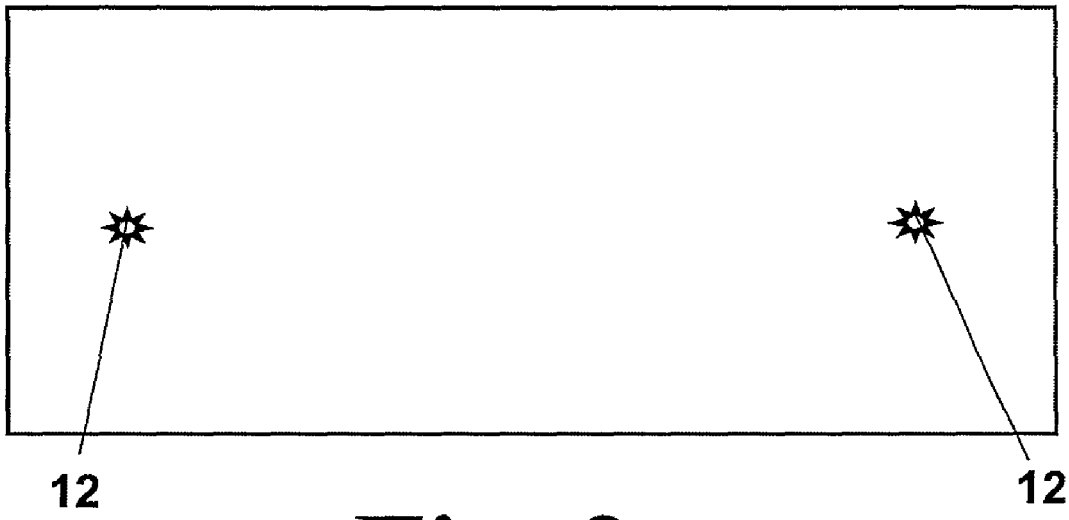
FIGS. 2*a* and 2*b* are plan views of alternative embodiments of the invention.

FIG. 2*a* shows a loudspeaker which is generally similar to that of FIG. 1*a* except that the diaphragm is an elongate rectangular shape. The diaphragm has increased width compared to the beam shaped diaphragm of FIG. 1*a*. The transducers 12 are mounted in the same location as in FIG. 1*a* and may also provide left and right channels for a stereo device.

As with FIG. 1*a*, the two transducers are mounted on nodes of both the first and second free resonant modes. The symmetrical locations result in this solution to the first two modes with piston equivalent operation achieved up to the second modal frequency. However this diaphragm must be regarded as a free plate and not significantly restrained by suspension components at the edge or centre.

Using only two transducers may impair the pistonic motion of the panel at low frequencies, if the panel material is not sufficiently stiff. One solution is to use a significantly stiffer panel material, for example a honeycomb material, e.g. Honipan HHM-PGP-2.2 mm. The response around the fundamental resonance will be smoothed and efficiency is higher due to reduced moving mass.

The size of the transducer voice coil corresponds to a substantial proportion of the width of the radiating panel. In such a case, the drive may be resolved as a pair of drive lines which are in fact equivalent to two drives. For such narrow panels, it is necessary to select cooperative choices of voice coil diameter, the effective mass shared at the drive lines and the effective placement for the identified nodal line grouping to achieve the required goal of usefully balanced modal radiation.

Figure 2B:
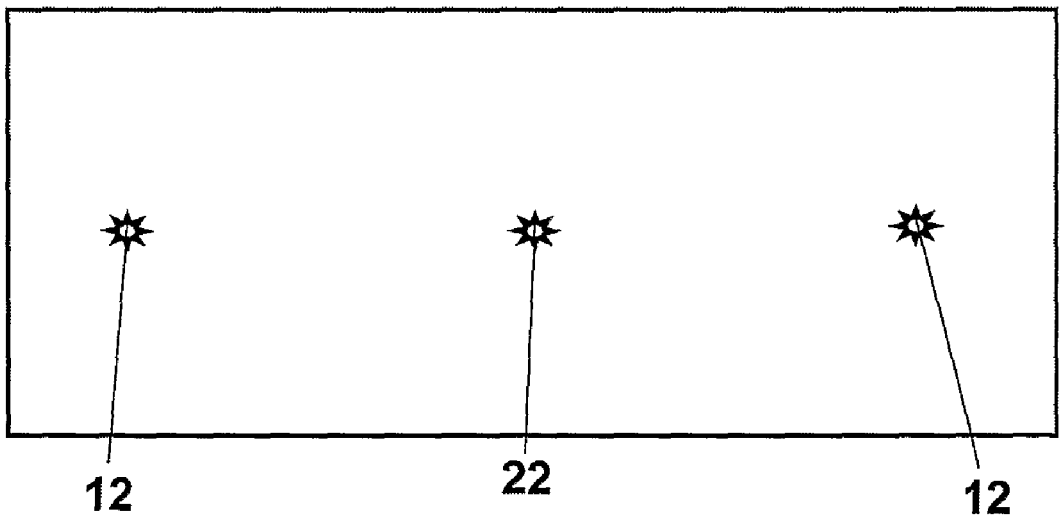

In FIG. 2*b*, the loudspeaker is similar to that of FIG. 2*a* but comprises an additional transducer 22 centrally mounted on the diaphragm. The two outermost transducers 12 are located near to the nodal lines for the first and second modes. The third transducer 22 is located at the node of the third mode. In this way, a three mode solution has been designed with three drives only. The location of the transducers corrects from the dominant, i.e. length, axis only. The requirement to bring the trend of average transverse velocity to zero is satisfied for this dominant length axis.

The loudspeaker may reproduce one sound channel. Alternatively, two or three sound channels may be reproduced. For two sound channels, the central transducer may be filtered out at high frequencies while the two separated drivers, located near the ends of the diaphragm constitute the left and right signal channels as with FIG. 1*a*. For a three channel device, the central transducer 22 is also driven selectively at higher frequencies by the centre channel signal source. It forms a dialogue or centre channel reproducer.

Figure 3A:
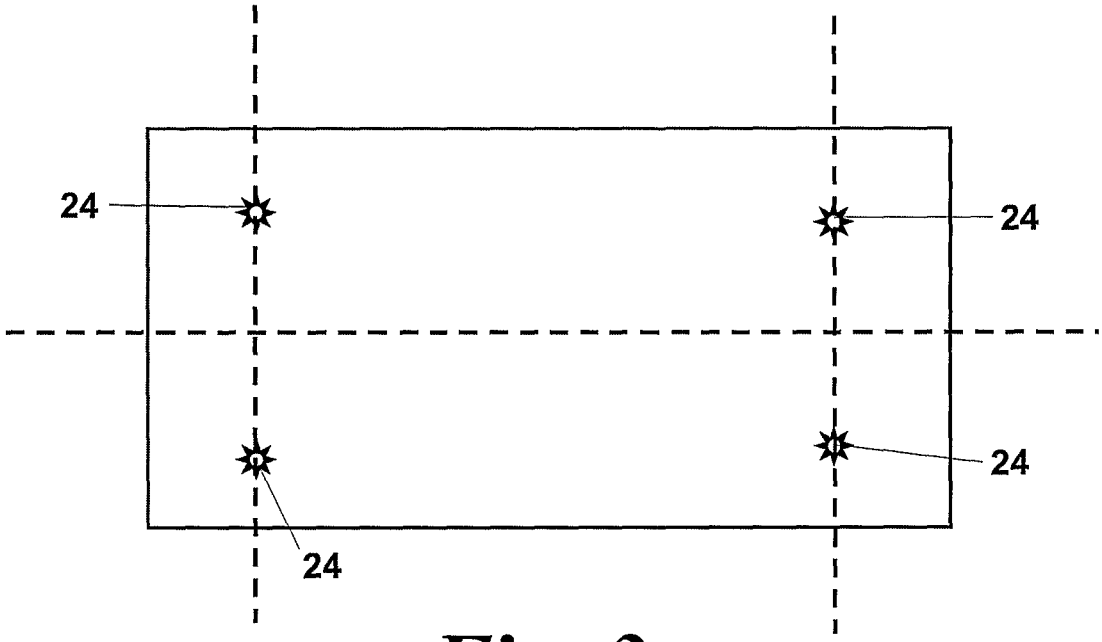
FIGS. 3*a* and 3*b* are plan views of alternative embodiments of the invention.
Figure 3B:
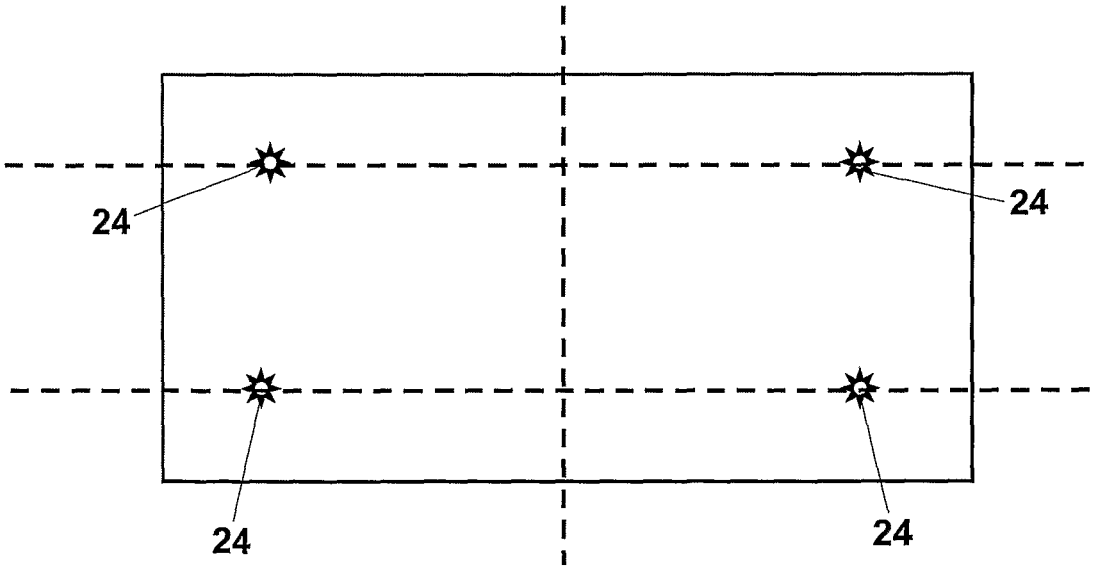

As explained above, FIG. 2*b* is the three mode solution for the dominant length axis. FIGS. 3*a* and 3*b* show the transducers locations 24 for a four mode solution. The location relative to the dominant length axis is shown in FIG. 3*a* and the location relative to the width axis in FIG. 3*b*. The solution is achieved with only four transducers which form two symmetrically placed pairs of transducers. As shown in FIG. 3*a*, each pair of transducers lies on a line parallel to the short axis which is 23% of the length of the panel from the closest short edge. Similarly, each parallel line shown in FIG. 3*b* is 23% of the length of the panel from the closest long edge. The transducers locations are symmetric about both axes. The symmetrical design maintains good dynamic balance at low frequencies improving power handling in the lower frequency piston or whole-body-motion range.

Figure 4:
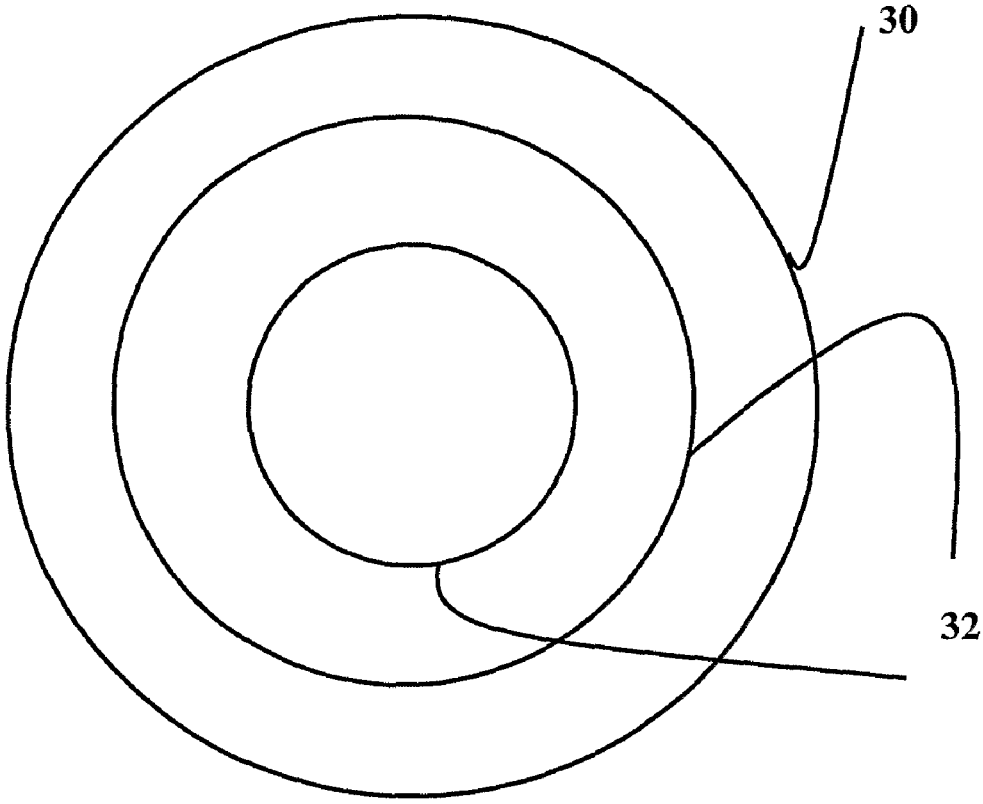
FIG. 4 is a plan view of an alternative embodiment of the invention.

FIG. 4 shows the two mode solution for a circular shaped diaphragm 30. Transducers having circular drives 32 are mounted on the nodal lines of the first and second modes.

Figure 5A:
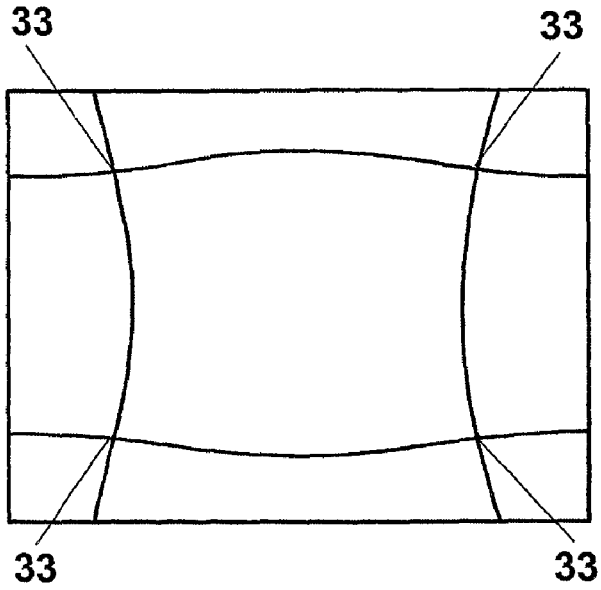
FIGS. 5*a* to 5*e* illustrate the concept of the third and fourth aspects of the invention.

To achieve modal balancing of two or more modes at the same time, the selected modes should have nodal lines which intersect or nearly intersect in the same localised region. The transducer should be located in this localised region. This is easily achievable for the case of two modes since most modes will have nodal lines spread out across the entire diaphragm giving at least one place on the panel where the nodal lines cross. FIG. 5*a* shows the nodal lines (0,2) and (2,0) of a rectangular panel diaphragm which intersect in four locations 33. A transducer may thus be mounted at any one or all of these locations to achieve a two mode solution. The node references (0,2) and (2,0) refer to the first resonant bending wave mode in the long axis and short axis, respectively. Each mode has two nodal lines and is symmetrical.

Figure 5B:
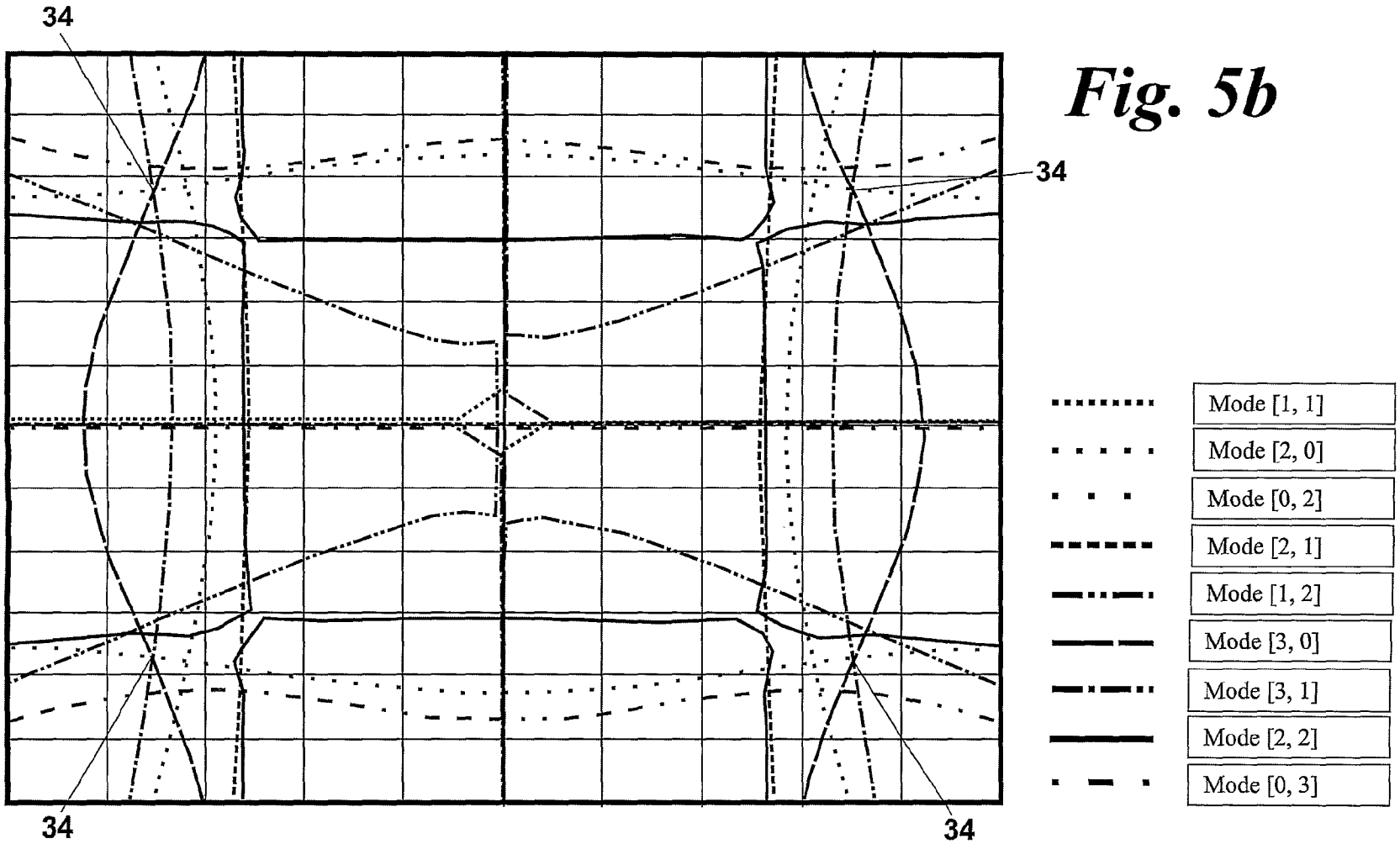

It is more difficult to suppress more than two modes. FIG. 5*b* shows nine modes (1,1) to (0,3). Three nodal lines intersect at four discrete points 34 and two additional nodal lines passing close to each intersection point. These five nodal lines are thus clustered about locations which may be termed nodal grouped locations. The grouped locations are symmetrically placed on the panel. By appropriate selection of the panel shape, the nodal lines may be clustered or declustered so that groups of selected modes may be suppressed. The clustering may be considered tight if the nodal lines cross within an area smaller than the drive part coupling of the transducer and loose if the area is larger.

Figure 5C:
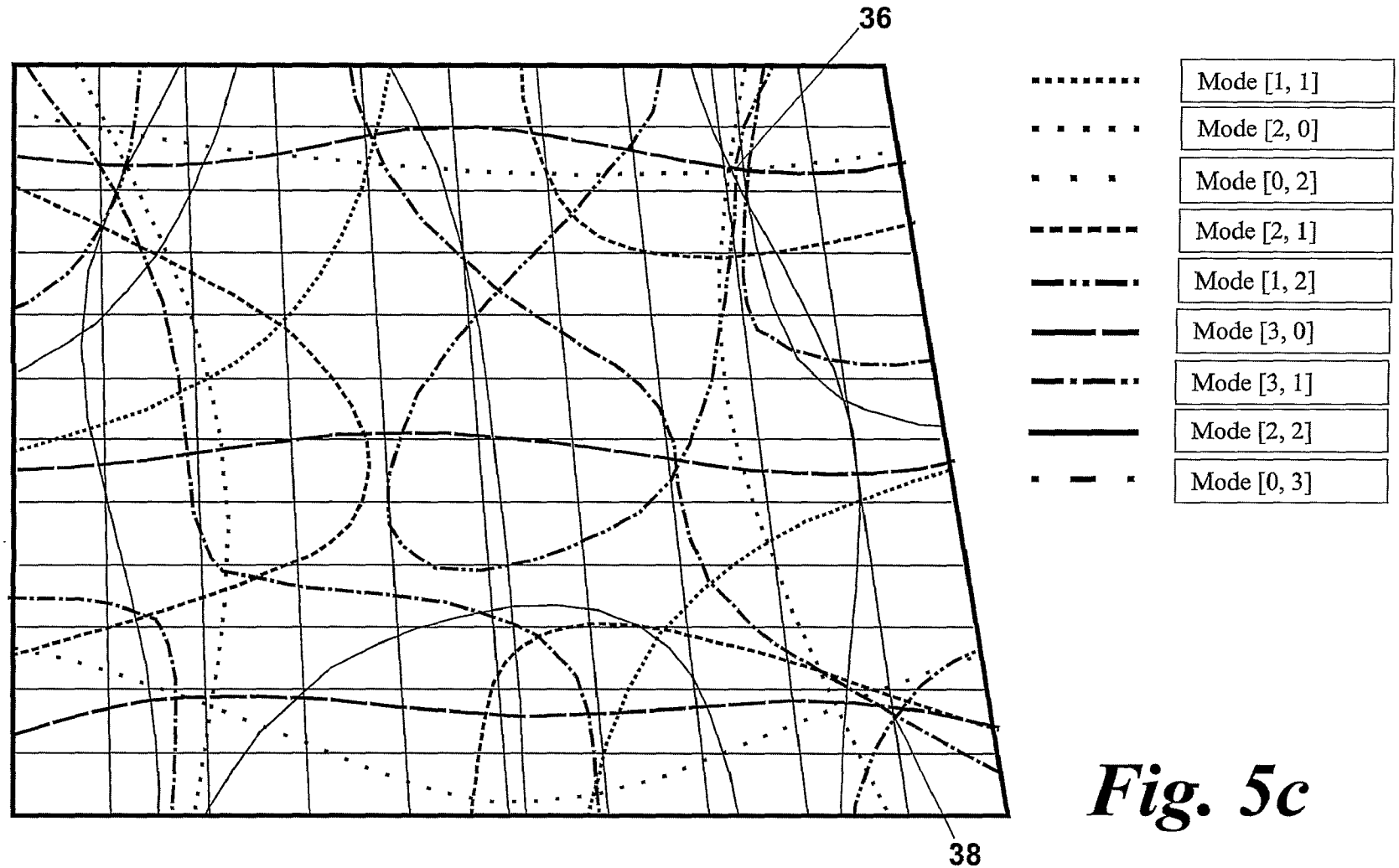
Figure 5D:
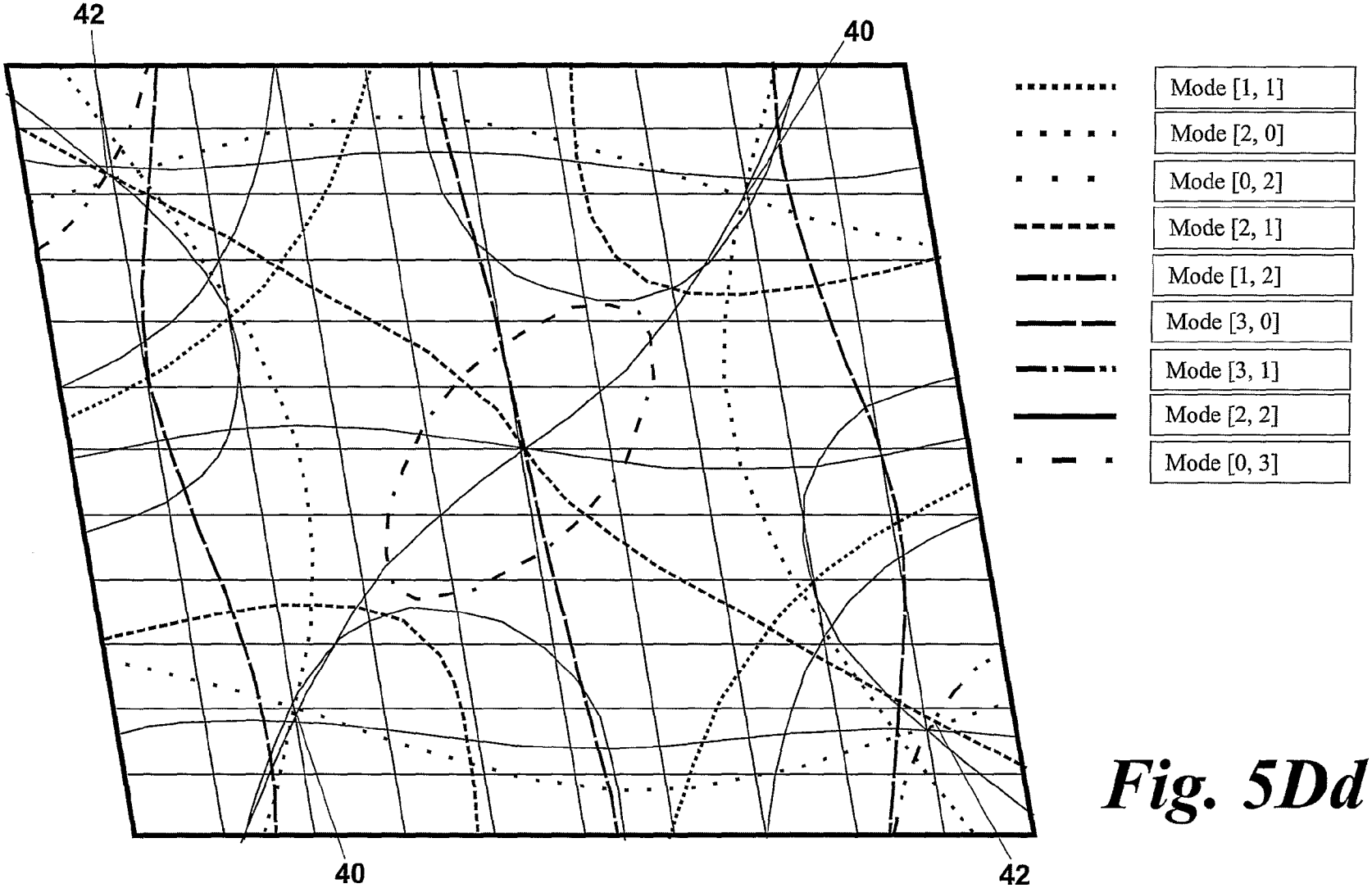
Figure 5E:
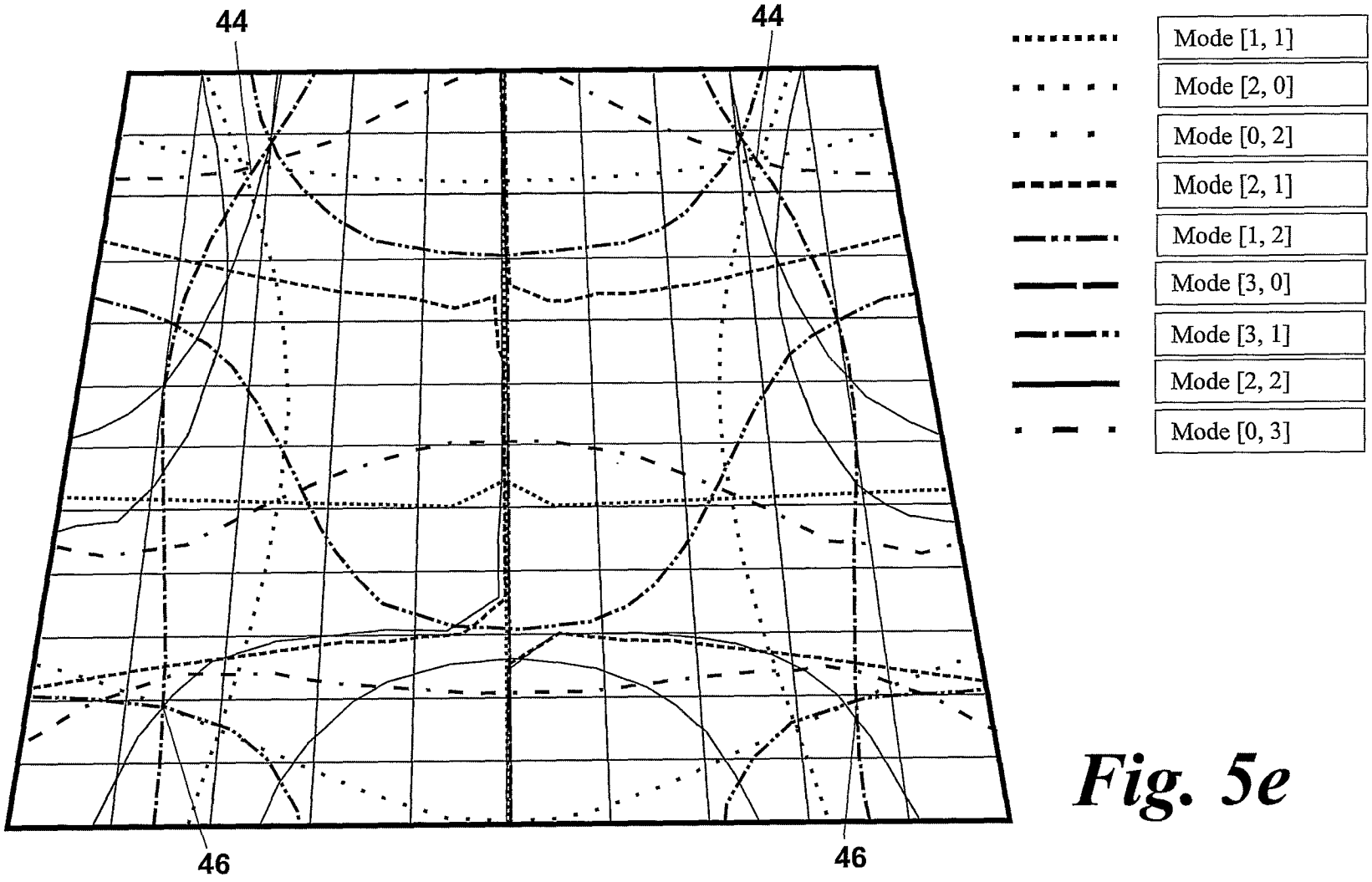

The panel of FIG. 5*b* has an aspect ratio of 4:3 (length: width). FIGS. 5*c* to 5*e* show variations of the panel for FIG. 5*b*. For convenience, the mode numbering in each of FIGS. 5*c* to 5*e* is the same as that in FIG. 5*b*, although since the panels are not rectangular, this notation does not strictly apply. As shown in FIG. 5*c*, tapering one side of the panel so that the ratio of the two lengths is 4:3.5 (i.e. reducing one side by 12.5%), results in a substantial tightening of the clusters, particularly for the grouped nodal location adjacent the short side and the tapered side. Here, five modes intersect at almost the same point 36 with two more modes passing close to this intersection point 36. Accordingly, seven modes (nodal lines) are now in this nodal grouped location. The other nodal grouped location 38 adjacent the tapered side (i.e. close to the long side), also has improved clustering with five modes closely clustered. In contrast to the embodiment of FIG. 5*b*, the four locations no longer are symmetrical nor have equal clustering.

In FIG. 5*d*, both sides of the panel have now been tapered to form a parallelogram of length to width ratio 3.5:3. There is some symmetry about the diagonals of the panel with two locations 40 having tight clusters of five nodal lines and the other two locations 42 having different shaped but similarly tight clusters of five nodal lines.

In FIG. 5*e*, both sides of the panel have now been tapered to form a trapezium of ratio 4:3:3 (length of long side to length of short side to width). There is some symmetry about the short axis of the panel with the two nodal grouped locations 44 closest to the short side having tight clusters of five nodal lines. The nodal grouped locations 46 are significantly looser closer to the long side.

Figure 6A:
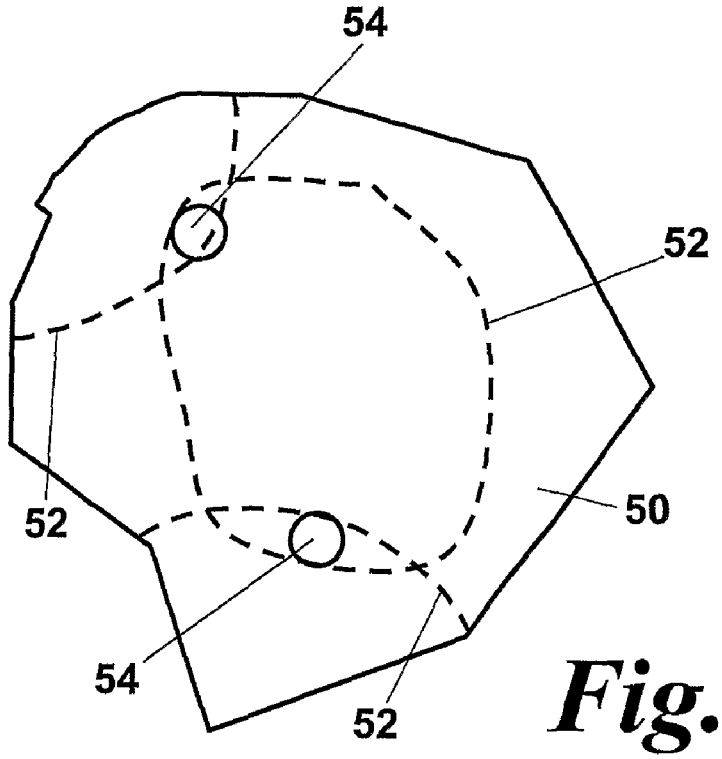
FIGS. 6*a* and 6*b* are plan views of a complex shaped embodiment.

In FIG. 6*a*, a panel diaphragm 50 having complex geometry is shown. The nodal lines 52 of two modes are shown, the first ring mode and the first cross-mode. The nodal lines intersect at four intersection points which may be grouped into two pairs of closely spaced intersection points. Each pair defines an average nodal location at which a transducer 54 is coupled to the panel diaphragm. By mounting each transducer 54 at the average nodal location rather than an intersection point, each transducer spans both nodal lines and couples better to the mode to achieve the desired modal balancing.

Figure 6B:
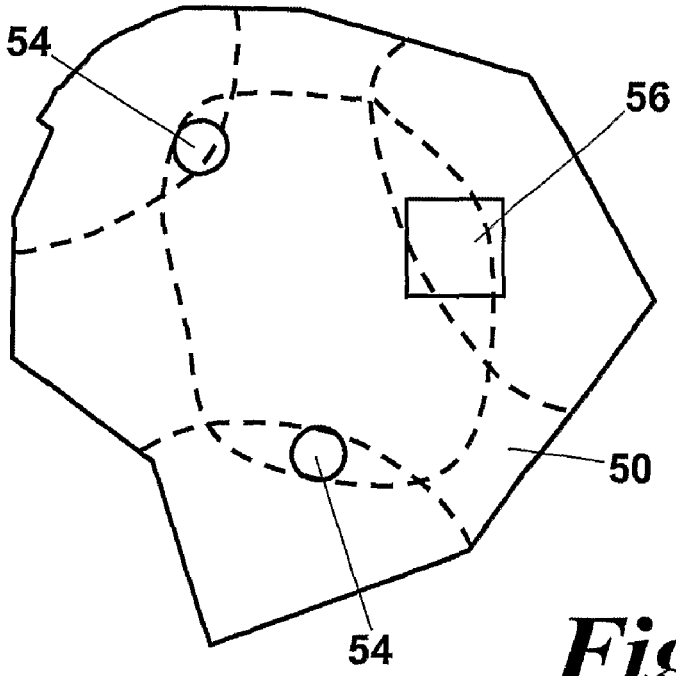

In FIG. 6*b*, a second cross mode is shown on the panel diaphragm. The ring mode intersects this second cross mode at a pair of closely spaced intersection points defining a third average nodal location. An additional mass 56 is mounted to the panel 50 to span both nodal lines. The two transducers balance the first two modes which are dominant in the acoustic response. The additional mass balances the third mode and assists in the dynamically balancing the whole assembly.

Figure 7A:
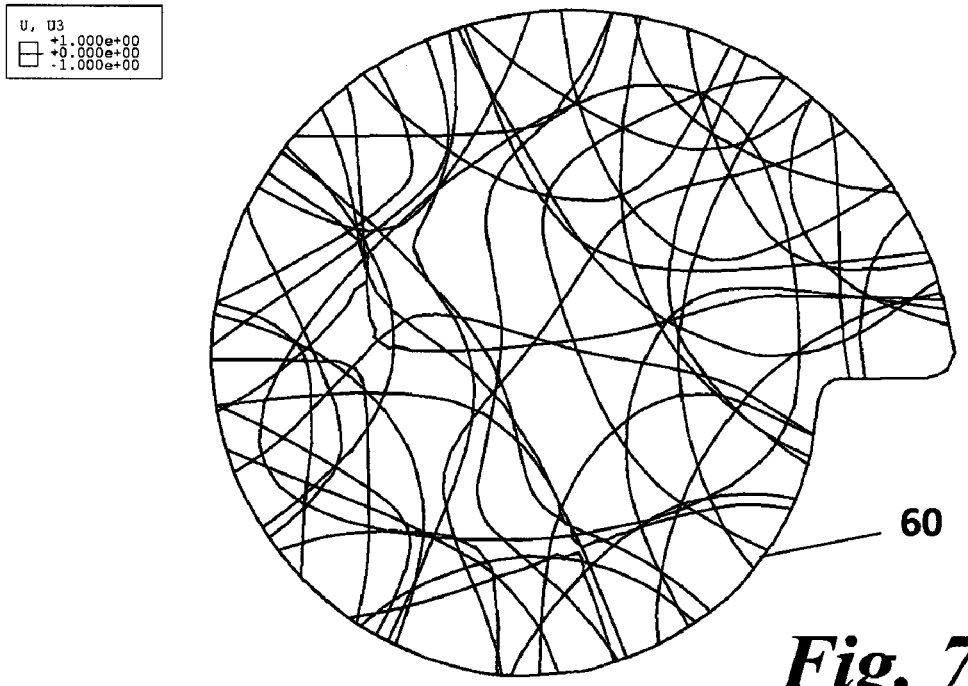
FIGS. 7*a* and 7*b* are plan views showing the nodal line maps of an alternative complex shaped embodiment.

FIG. 7*a* shows another complex shaped panel diaphragm 60 which is in the shape of a conch shell. The first twelve modes are shown on the panel. For a prior art distributed mode loudspeaker of the type shown in WO 97/09842, the transducers would be mounted in the empty areas for maximum modal coupling. However in the present invention, the transducers are mounted at nodal grouped locations where nodal lines are clustered.

Figure 7B:
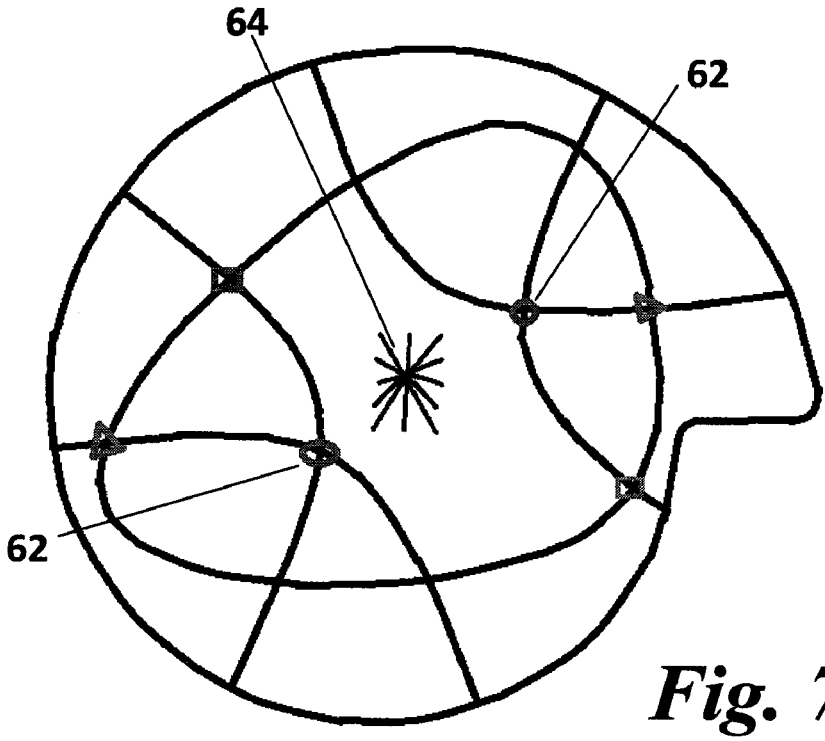

FIG. 7*b* simplifies the choice of the location of the transducer by considering only the first three modes. If a transducer were mounted at the intersection points 62 of the first two axial modes (denoted with a small circle), the first (and only) radial mode would be unbalanced. One solution would be to mount at these points and load the edge with a balancing mass so that the radial mode is re-balanced.

Comparing the two Figures, the clusters of nodal lines in FIG. 7*a* correspond in many cases with the intersections of the modes shown in FIG. 7*b*. Accordingly, an alternative solution is to use a pair of such points as drive points, with the pair diametrically opposed relative to the centroid 64 of the shape (marked with a star). The radial mode will be balanced by virtue of driving on its nodal line. The two axial modes will be balanced by virtue of symmetrical loading. The precise location of the drive points may be determined by analysis—either numerical (e.g. finite element analysis) or by systematic measurement and adjustment. Suggested starting points are indicated by the rectangles and the triangles.

The rectangles lie very close of the centre-line of the mode-shapes passing through the circles and the triangles. Accordingly, additional balancing points may be required near the unmarked intersections. These will balance the effects of drive masses near the rectangles.

The fundamental principle may be extended to more complex diaphragm shapes whose modal behaviour may nevertheless be resolved analytically into simpler groupings. Those groupings will correspond to underlying degrees of freedom or effective vibration axes. The designer of an acoustic panel may choose to address several of these axes using multiple exciters, employed according to the number of modes worth solving and the cost and quality anticipated for the intended application.

The principle may be used on its own, or in conjunction with other modal panel art, e.g. distributed mode (DM) technology.

The main advantages of this device over a BMR device are:

1) by forcing, i.e. driving, all the average nodal positions taught by BMR, it produces more output than the BMR
2) although the directivity would be narrower than for the BMR, this may be an advantage in some circumstances.

A device according to the invention differs to that of a pistonic loudspeaker, including a pistonic loudspeaker in which modes are cancelled, for several reasons, e.g.:

a) It is intendedly resonant modal radiator.
b) The design is configured so that the device has a power response superior to a pistonic device of equivalent size by virtue of the designed off axis modal radiation contribution.
c) It has a smooth axial frequency response because the modal radiation is balanced leaving the inherently uniform whole body radiation to maintain the primary sound output.
d) There is an orderly design method provided to solve the mode balancing issue, starting from the high order modes, whereby all succeeding lower order modes are dealt with as a group by using the method of multiple drives at regions of average nodal lines on the resonating panel.
e) The panel may be freely suspended in free space or provided with a light weight suspension. With the latter, an acoustic seal between front and rear radiation can be provided.

An additional advantage is that by allowing symmetrical arrangements, a device according to the invention has improved low-frequency stability than prior art devices that require asymmetry.

The invention claimed is:

1. An acoustic device comprising a diaphragm having an area and having an operating frequency range and the diaphragm being such that it has resonant bending wave modes in the operating frequency range, and a plurality of electromechanical transducers coupled to the diaphragm and adapted to exchange energy with the diaphragm, characterised in that the positioning and mechanical impedance of the transducers are such that the net transverse modal velocity over the area of the diaphragm is at least reduced to tend to balance at least selected modes in the operating frequency range with the balancing of the selected resonant bending wave modes being achieved substantially by the positioning and mechanical impedance of the transducers.

2. An acoustic device according to claim 1, wherein the transducers are mounted at average nodal locations.

3. An acoustic device according to claim 1 or claim 2, wherein the transducers are mounted symmetrically on the diaphragm.

4. An acoustic device according to claim 3, wherein the diaphragm is a rectangular diaphragm and comprises three transducers which are symmetrically placed about the longer axis and a pair of transducers symmetrically placed about the shorter axis.

5. An acoustic device according to claim 1, wherein at least two of the transducers have different drive magnitudes.

6. An acoustic device according to claim 1, wherein the mechanical impedance of each transducer is matched to the effective mechanical impedance at the drive location.

7. An acoustic device according to claim 1, wherein the transducers are inertial.

8. An acoustic device according to claim 1, wherein the transducers are piezoelectric devices, bender devices or moving coil devices.

9. An acoustic device according to claim 1, comprising a compliant intermediary layer attached to the diaphragm with the mass, damping and compliance of the intermediate layer being such that output is reduced at low frequencies but unaffected at higher frequencies.

10. An acoustic device according to claim 1, comprising a resilient suspension coupling the diaphragm to a chassis.

11. An acoustic device according to claim 10, wherein the positions and mechanical impedance of the transducers are such as to compensate for the mechanical impedance effect of the suspension.

12. An acoustic device according to claim 1, wherein the parameters of the diaphragm are such that there are a plurality of nodal grouped locations at or around which the nodal lines of the selected resonant modes are clustered and each transducer is mounted at one of the plurality of nodal grouped locations.

13. An acoustic device according to claim 12, wherein the selected modes are low frequency resonant modes.

14. An acoustic device according to claim 12, wherein the selected modes are any combination of odd and/or even modes.

15. An acoustic device according to claim 12, wherein the diaphragm parameters include shape, size, thickness, bending stiffness, surface area density, shear modulus, anisotropy, curvature and damping.

16. An acoustic device according to claim 12, wherein the diaphragm has an uneven geometric shape and the shape has been selected according to the desired position of or to the desired combination of nodal lines clustered in selected nodal grouped locations.

17. An acoustic device according to claim 16, wherein the diaphragm comprises grooves whereby the uneven shape is vibrationally resolved into a uniform shape.

18. An acoustic device according to any claim 12, wherein the diaphragm has integral contours or ridges whereby nodal lines are displaced to alter the position of the nodal grouped locations or to alter the nodal lines clustered in the nodal grouped locations.

19. An acoustic device according to claim 1, wherein the diaphragm has increased local thickness by adding an "I" shaped extension which does not increase local stiffness in the dominant plane of bending.

20. An acoustic device according to claim 1, wherein the operating frequency range includes the piston-to-modal transition.

21. An acoustic device according to claim 20, wherein the parameters of the device are such as to achieve a desired ratio of pistonic to modal output.

22. An acoustic device according to claim 1, wherein the acoustic device is a loudspeaker and at least one of the transducers is adapted to apply bending wave energy to the diaphragm in response to an electrical signal applied to the transducer and the diaphragm is adapted to radiate sound over a radiating area.

23. A method of making an acoustic device having a diaphragm having an area and having an operating frequency range, comprising choosing the diaphragm parameters such that it has resonant bending wave modes in the operating frequency range, coupling a plurality of electromechanical transducers to the diaphragm to exchange energy with the diaphragm, characterised by selecting the positions and mechanical impedance of the transducers so that the net transverse modal velocity over the area is at least reduced to tend to balance at least selected modes in the operative frequency range with the balancing of the selected resonant bending wave modes being achieved substantially by the positioning and mechanical impedance of the transducers.

24. A method according to claim 23, comprising mounting the transducers at average nodal locations.

25. A method according to claim 23 or claim 24, comprising mounting the transducers symmetrically on the diaphragm.

26. A method according to claim 23, comprising coupling at least two transducers with different drive magnitudes.

27. A method according to claim 23, comprising matching the mechanical impedance of each transducer to the effective mechanical impedance at the drive location.

28. A method according to claim 23, comprising attaching a compliant intermediary layer to the diaphragm and selecting the mass, damping and compliance of the intermediate layer so that output is reduced at low frequencies but unaffected at higher frequencies.

29. A method according to claim 23, comprising coupling the diaphragm to a chassis via a resilient suspension.

30. A method according to according to claim 29, comprising selecting the positions and mechanical impedance of the transducers so as to compensate for the mechanical impedance effect of the suspension.

31. A method according to claim 23, comprising selecting a number of resonant modes, selecting the parameters of the diaphragm so that there are a plurality of nodal grouped locations at or around which the nodal lines of the selected number of resonant modes are clustered and mounting each transducer at one of the plurality of nodal grouped locations.

32. A method according to according to claim 31, comprising selecting low frequency resonant modes.

33. A method according to according to claim 31, comprising selecting any combination of odd and/or even modes.

34. A method according to claim 31, wherein the diaphragm parameters include shape, size, thickness, bending stiffness, surface area density, shear modulus, anisotropy, curvature and damping.

35. A method according to claim 31, comprising selecting a desired position of or a desired combination of nodal lines clustered in selected nodal grouped locations and selecting an uneven geometric shape for the diaphragm which results in the desired position or the desired combination.

36. A method according to claim 35, comprising grooving the diaphragm to vibrationally resolve the uneven shape into a uniform shape.

37. A method according to claim 31, comprising displacing nodal lines in the diaphragm by providing the diaphragm with integral contours or ridges whereby the position of or the nodal lines clustered in selected nodal grouped locations is altered.

38. A method according to claim 23, comprising selecting the parameters of the device to achieve a desired ratio of pistonic to modal output.

39. An acoustic device comprising a diaphragm having an area and having an operating frequency range and the diaphragm being such that it has resonant bending wave modes in the operating frequency range, and at least one electromechanical transducer coupled to the diaphragm and adapted to exchange energy with the diaphragm, characterised in that the parameters of the diaphragm are such that there are a plurality of nodal grouped locations at or around which the nodal lines of a selected number of resonant modes are clustered and the at least one transducer is mounted at one of the plurality of nodal grouped locations.

40. An acoustic device according to claim 39, wherein the selected modes are low frequency resonant modes.

41. An acoustic device according to claim 39, wherein the selected modes are any combination of odd and/or even modes.

42. An acoustic device according to claim 39, wherein the diaphragm parameters include shape, size, thickness, bending stiffness, surface area density, shear modulus, anisotropy, curvature and damping.

43. An acoustic device according to claim 39, wherein the diaphragm has an uneven geometric shape and the shape has been selected according to the desired position of or to the desired combination of nodal lines clustered in selected nodal grouped locations.

44. An acoustic device according to claim 43, wherein the diaphragm comprises grooves whereby the uneven shape is vibrationally resolved into a uniform shape.

45. An acoustic device according to claim 39, wherein the diaphragm has integral contours or ridges whereby nodal lines are displaced to alter the position of the nodal grouped locations or to alter the nodal lines clustered in selected nodal grouped locations.

46. An acoustic device according to claim 39, wherein the operating frequency range includes the piston-to-modal transition.

47. An acoustic device according to claim 39, wherein the positioning and mechanical impedance of the transducers are such that the resonant bending wave modes are balanced so that the net transverse modal velocity over the area of the diaphragm tends to zero with the balancing of the resonant bending wave modes being achieved entirely by the positioning and mechanical impedance of the transducers.

48. An acoustic device according to claim 47, wherein the transducers are mounted at average nodal locations.

49. An acoustic device according to claim 47, comprising a resilient suspension coupling the diaphragm to a chassis.

50. An acoustic device according to claim 49, wherein the positions and mechanical impedance of the transducers are such as to compensate for the mechanical impedance effect of the suspension.

51. An acoustic device according to claim 39, wherein at least two of the transducers have different drive magnitudes.

52. An acoustic device according to claim 39, wherein the mechanical impedance of each transducer is matched to the effective mechanical impedance at the drive location.

53. An acoustic device according to claim 39, comprising a compliant intermediary layer attached to the diaphragm with the mass, damping and compliance of the intermediate layer being such that output is reduced at low frequencies but unaffected at higher frequencies.

54. A method of making an acoustic device having a diaphragm having an area and having an operating frequency range, comprising choosing the diaphragm parameters such that it has resonant bending wave modes in the operating frequency range, coupling at least one electromechanical transducer to the diaphragm to exchange energy with the diaphragm, characterised by selecting the parameters of the diaphragm so that there are a plurality of nodal grouped locations at or around which the nodal lines of a selected number of resonant modes cluster and coupling the at least one transducer at one of the plurality of nodal grouped locations.

55. A method according to according to claim 54, comprising selecting low frequency resonant modes.

56. A method according to according to claim 54, comprising selecting any combination of odd and/or even modes.

57. A method according to claim 54, wherein the diaphragm parameters include shape, size, thickness, bending stiffness, surface area density, shear modulus, anisotropy, curvature and damping.

58. A method according to claim 54, comprising selecting a desired position of a nodal grouped location or a desired combination of nodal lines clustered in a nodal grouped location and selecting an uneven geometric shape for the diaphragm which results in the desired position or the desired combination.

59. A method according to claim 58, comprising grooving the diaphragm to vibrationally resolve the uneven shape into a uniform shape.

60. A method according to claim 54, comprising providing the diaphragm with integral contours or ridges whereby the position of the nodal grouped locations or the nodal lines clustered in selected nodal grouped locations is altered.

61. A method according to claim 54, comprising selecting the parameters of the device to achieve a desired ratio of pistonic to modal output.

62. A method according to claim 54, comprising matching the mechanical impedance of each transducer to the effective mechanical impedance at the drive location.

63. A method according to claim 23, comprising attaching a compliant intermediary layer to the diaphragm and selecting the mass, damping and compliance of the intermediate layer so that output is reduced at low frequencies but unaffected at higher frequencies.

64. A method according to claim 54, comprising coupling the diaphragm to a chassis via a resilient suspension.

65. A method according to according to claim 64, comprising selecting the positions and mechanical impedance of the transducers so as to compensate for the mechanical impedance effect of the suspension.

* * * * *